US009995063B2

(12) United States Patent
Andersen

(10) Patent No.: US 9,995,063 B2
(45) Date of Patent: Jun. 12, 2018

(54) SAFETY GATE

(71) Applicant: Jesper Birk Andersen, Kowloon (CN)

(72) Inventor: Jesper Birk Andersen, Kowloon (CN)

( * ) Notice: Subject to any disclaimer, the term of this patent is extended or adjusted under 35 U.S.C. 154(b) by 0 days. days.

(21) Appl. No.: 15/621,054

(22) Filed: Jun. 13, 2017

(65) Prior Publication Data

US 2018/0044940 A1 Feb. 15, 2018

(30) Foreign Application Priority Data

Aug. 11, 2016 (GB) ..... 1613832.3

(51) Int. Cl.
*E06B 9/02* (2006.01)
*E05B 65/00* (2006.01)
(Continued)

(52) U.S. Cl.
CPC ..... *E05B 65/0014* (2013.01); *E05B 65/0007* (2013.01); *E06B 9/02* (2013.01); *E05B 17/22* (2013.01); *E06B 2009/002* (2013.01)

(58) Field of Classification Search
CPC ..... E06B 2009/002; E06B 9/04; E06B 9/02; E05B 65/0007; E05B 65/0014; E05B 17/0079; E05Y 2900/40
See application file for complete search history.

(56) References Cited

U.S. PATENT DOCUMENTS 3,541,844 A * 11/1970 Stover ..... G01L 1/22 73/761
4,583,715 A * 4/1986 Wright ..... E01F 13/06 160/225
(Continued)

FOREIGN PATENT DOCUMENTS

EP 1146196 A2 10/2001
EP 2014863 A2 1/2009
WO WO 2006/063590 A1 6/2006

OTHER PUBLICATIONS

UK Search Report of Application Serial No. GB 1613832.3 dated Feb. 3, 2017, 1 page.

*Primary Examiner* — Justin B Rephann
(74) *Attorney, Agent, or Firm* — Fay Sharpe LLP

(57) ABSTRACT

The invention relates to a safety gate including a frame with a horizontal base member and usually two vertical upright post members affixed to each end of the base member at its lower end; a door mounted for hinged opening movement, hingedly attached to the vertical upright post member; the frame being held in position by frictional engagement against supporting walls of an opening, provided and adjusted by attachment means which are mounted on adjusting rods; the door includes an upper bar and a lower bar connected together with a number of pales spaced apart to form an effective barrier; the door also including a closing mechanism for releasibly retaining the door in the closed position. The attachment means includes a pressure gauge which measures the frictional pressure between the frame and supporting wall of the opening, and an electronic processing means which compares the pressure reading from the pressure gauge to a predetermined level and indication means which provide an indication when the measured pressure level is lower than the predetermined level. Power storage means are provided to provide autonomous power to the processor and the indication means. The indication means includes a wireless transmission means to transmit the indication of low pressure to a computer, tablet or smart phone.

10 Claims, 2 Drawing Sheets

(51) Int. Cl.
*E05B 17/22* (2006.01)
*E06B 9/00* (2006.01)

(56) References Cited

U.S. PATENT DOCUMENTS

| | | | | |
|---|---|---|---|---|
| 6,301,832 | B1 | 10/2001 | Anderson | |
| 2004/0238806 | A1* | 12/2004 | Hicks | E06B 9/04 256/19 |
| 2009/0013604 | A1* | 1/2009 | Yates | E05B 65/0007 49/49 |
| 2010/0302025 | A1* | 12/2010 | Script | G01P 15/09 340/539.1 |
| 2012/0324792 | A1* | 12/2012 | Bertsch | E06B 9/04 49/37 |
| 2013/0125470 | A1* | 5/2013 | Dunn | E06B 9/04 49/381 |
| 2013/0212950 | A1* | 8/2013 | Bertsch | E06B 9/04 49/464 |
| 2014/0190081 | A1* | 7/2014 | Wanjohi | A47G 29/126 49/25 |

* cited by examiner

SAFETY GATE

REFERENCE TO RELATED APPLICATION

This application claims priority to and the benefit of UK patent application G1613832.3, filed Aug 11, 2016 and entitled "Safety Gate", the entirety of which is hereby incorporated by reference.

BACKGROUND AND SUMMARY OF THE INVENTION

The present invention relates to a safety barrier of the type which includes a door section mounted in a frame, the safety gate being fastenable in an opening using clamping devices which can be clamped against the sides of the opening. The frame may consist of an L frame with a hinged door section or more often a U frame with a hinged door section. The L frame and the U frame are both to remain in position in the opening into which they are installed whilst the door section is openable for passing through.

Child safety gates are used as temporary barriers across doorways, stairways, windows, and similar openings to prevent small children and animals from passing there-through.

The purpose of this invention is to provide gates of enhanced reliability. The gate has improved securing means to secure the frame to the walls of the opening and to maintain the frame in a secure condition and to maintain reliable safe operation of the opening door through the continued use of the gate.

Accordingly there is provided an invention for a safety gate as defined in the appended claims.

BRIEF DESCRIPTION OF THE DRAWINGS

An embodiment of the invention shall be explained further below with reference to the enclosed drawings.

DETAILED DESCRIPTION OF THE PREFERRED EMBODIMENT

Figure 1:
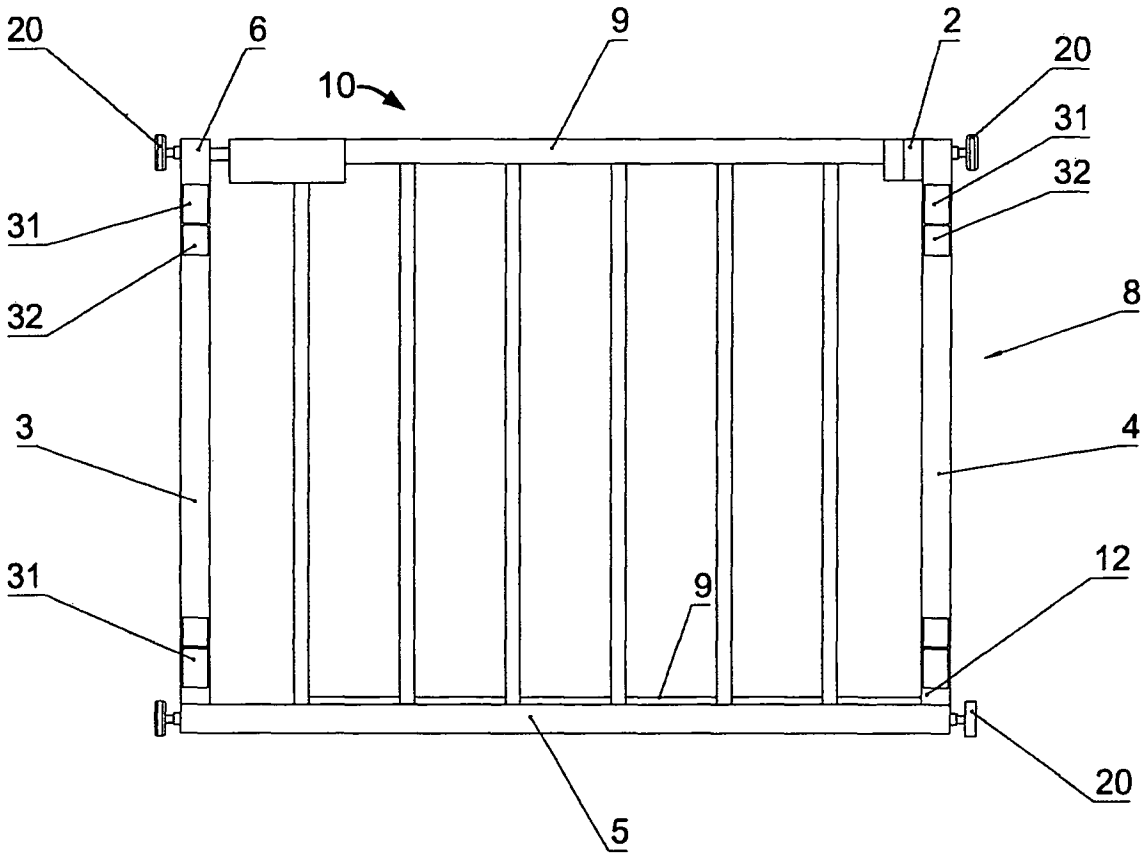
FIG. 1 is a side view of a child safety barrier constructed in accordance with a preferred embodiment of the present invention, the barrier including a frame and a door hinged thereto.

The safety gate includes a frame 8 having a horizontal base member 5 and vertical upright post members 3, 4, the vertical upright posts being securely affixed to each end of the base member 5 at their lower ends forming a U shaped frame. On the right hand post 4, as seen in FIG. 1, a door 10 is mounted for hinged opening movement on an upper hinge 2 and a lower hinge 12.

The U frame is held in position via pressure and or friction provided via the adjustable bolts 26 of the attachment means 20.

It is possible for the invention to be implemented with either an L shaped frame or a U shaped frame as shown in this embodiment, and the bottom horizontal tube in both the L and U frame will provide a rigid installation of the bottom of the frame because the base member 5 is straight, will provide the needed tension for the bottom of the safety gate, to remain in position during use. The base member 5 and the post members 3, 4 are preferably tubular.

The vertical post members of the L or U frame will need to be attached to the bottom frame either with an angle greater than 90 degrees, in their normal un tensioned state, typically 92-93 degrees, measured from the opening of the frame 8, so the upright post members 3, 4 are slightly splayed outwardly.

The frame 8 may be made from separate tubes welded, or otherwise permanently fixed together, or alternatively from a single tube that is bend to form the "U" at the required open angle over 90 degrees.

When applying force via the tightening of the tightening nut 25 the screw head 7 will be pushed out towards the opening frame structure 28. This opening frame member 28 is preferably rigid and immovable such that when the gate is secured in position the vertical members 3, 4 will be pushed towards the center of the opening. For the door section 10 of the gate to work the vertical members 3, 4 normally needs to be pushed to a 90 degree position relative to the bottom horizontal member 5.

For fastening of the safety gate frame 8 to the opening there is a frame attachment means 20 in each corner of the frame, that is, at both ends of the base member 5 and the free end of each post member 3, 4. The attachment means 20 will be described in more detail later.

The door 10 includes an upper bar 9 and a lower bar 9 connected together with a number of pales spaced apart to form an effective barrier. The door 10 also includes a closing mechanism 6 which may be any suitable child proof latch mechanism.

Figure 2:
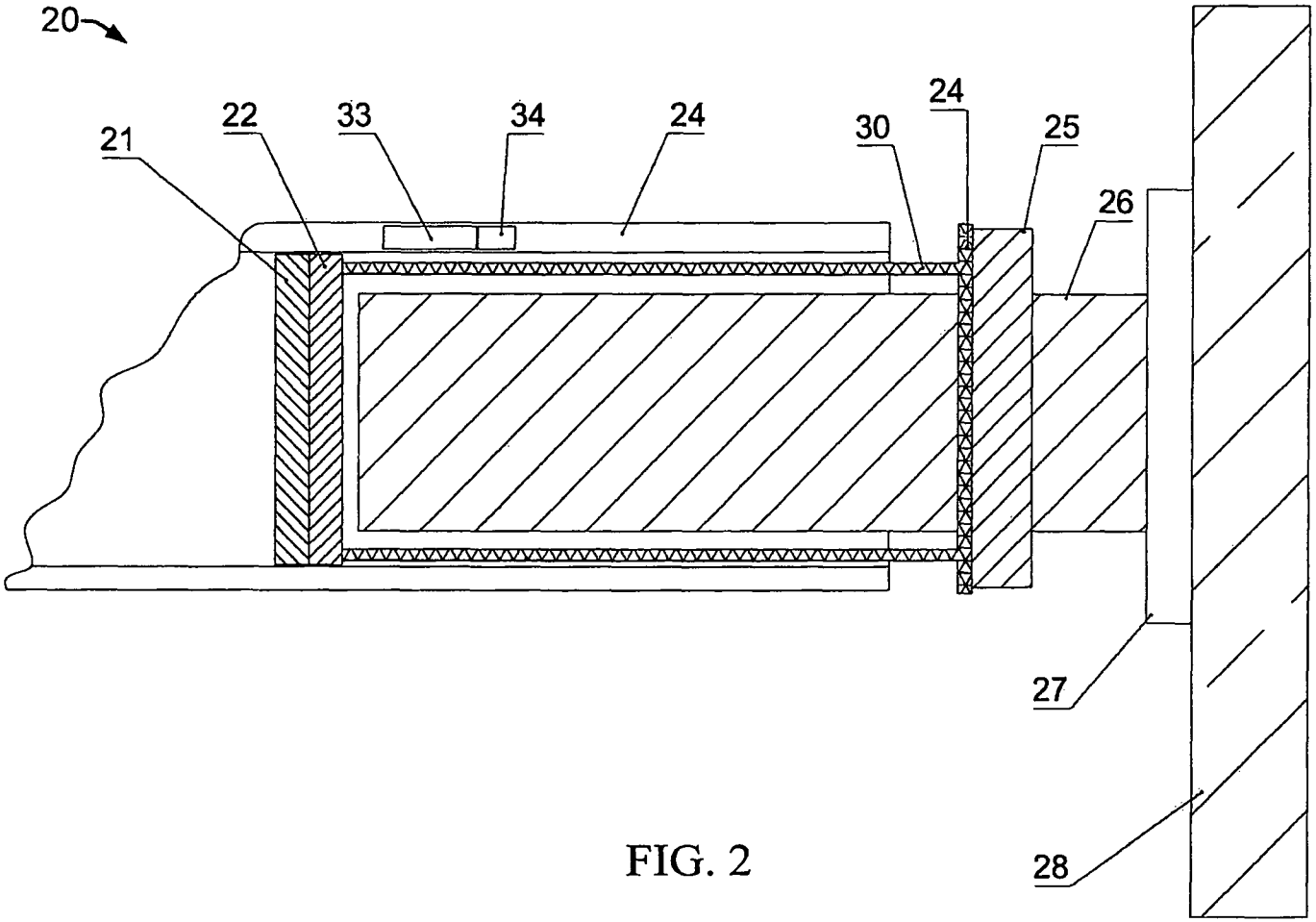
FIG. 2 is an enlarged side view of the frame attaching portion of the gate of FIG. 1.

Referring now to FIG. 2 the attachment means 20 is shown in more detail in an enlarged view. The attachment means includes a threaded bolt 26 with a friction block 27 forming a head of the bolt 26. A tightening nut 25 is threadingly mounted on the bolt 26 and the nut is in intimate contact with a mating face 24 of a tube 30 which is located in a recess 29 in the base member 5 or post member 3, 4 respectively. The opposite end of the tube 30 presses against the bottom stop surface 21 of the recess 29 such that when the nut 25 is rotated the threaded bolt moves outwardly or inwardly with respect to the base or post member according to the direction in which the nut 25 is rotated. The nut 25 is shaped for ease of turning by the user and is provided with an indication of the effect direction of turning, i.e. to tighten or release the frame.

Thus the nut 25 can be set at its innermost position and the frame 8 can be located in the desired position. The nut 25 is then rotated by the user to extend the bolt and thus the friction block 27 moves outwardly until is presses against the supporting surface 28 of the opening in which the safety gate is to be located. The nut is tightened by the user and secures the frame 8 against the opening surface 28.

Located between the opposite end of the tube 30 and the bottom stop surface 21 is a pressure gauge 22. This pressure gauge 22 measures the pressure exerted between the threaded bolt and bottom stop surface and thus gives a measure of the force exerted by the friction pad against the surface of the surrounding frame against which the safety gate is being fixed. The pressure gauge 22 is connected to a pressure indication means 31 which serves to indicate to the user that there is sufficient pressure to securely fix the gate in position in the surrounding frame. Thus the user can continue to turn the nut 25 to extend the bolt 26 until the desired satisfactory amount of fixing pressure is achieved then the user stops turning the nut, knowing that the gate is fixed properly. Not only does this enable the correct fixing of the gate by the user, it also prevents the user from over tightening the bolt which may lead to damage to the surrounding frame 28 and to the gate which it is desirable to avoid, but also such overtightening may cause the gate malfunction and to appear to be securely fixed when it is not and this itself leads to unsafe installation and operation of the gate. The indication means in this embodiment is a simple no then yes signal to the user in the form of a red light for when there is insufficient pressure and a green light when sufficient pressure is achieved. It will be appreciated that other forms of indication means could be used. In this embodiment there are four attachment means 20, each with their own indication means 30, so that the user can see that each of the four attachment means 20 is securely fixed.

Furthermore, during use the attachment means 20 may become loosened and the indication means 31 serves and as a continuous monitor and a warning that the attachment means needs tightening. In this way it is prevented that the gate becomes loose and unsafe without the knowledge of the local responsible adult.

A battery 33 is provided which provides the necessary electrical power for the pressure gauge and the indication means.

The indication means could also be audible.

In addition the pressure gauge 22 is connected to a transceiver 34 which sends a message to the responsible adult by lower power blue tooth to a computer device of the responsible adult such as a smart phone to provide an indication of the pressure gauge reading and more importantly in an indication that the pressure has dropped to a level which is not sufficient to provide a secure enough fixing and that the nut needs to be re-tightened.

In this embodiment solar panels 32 are also provided on the outside surface of the post members 3, 4 to provide the necessary charge to the battery and avoid the need for a battery change and battery change indication means.

Component List:

1—(Not Used)
2—Upper Hinge
3—First Vertical Upright Post Member
4—Second Vertical Upright Post Member
5—Horizontal Base Member
6—Closing Mechanism
7—(Not Used)
8—Frame
9—(Not Used)
10—Door
11—(Not Used)
12—Lower Hinge
13 to 19—(Not Used)
20—Frame Attachment Means
21—Bottom Stop Surface
22—Pressure Gauge
23—(Not Used)
24—Mating Face
25—Tightening Nut
26—Threaded Bolt
27—Friction Block
28—Supporting Surface
29—Recess
30—Tube
31—Pressure Indication Means
32—Solar Panels
33—Battery
34—Transceiver

The invention claimed is:

1. A safety gate including a frame having a horizontal base member and at least one vertical upright post member, the at least one vertical upright post member being securely affixed to one end of the base member at its lower end;

a door mounted for hinged opening movement, hingedly attached to the vertical upright post member;

the frame being held in position by frictional engagement against supporting walls of an opening, the friction engagement being provided and adjusted by attachment means which are mounted on adjusting rods;

the door includes an upper bar and a lower bar connected together with a plurality of pales spaced apart to form a barrier;

the door also including a closing mechanism for releasibly retaining the door in the closed position;

wherein the attachment means includes a pressure gauge which measures the frictional pressure between the frame and supporting wall of the opening, and an electronic processing means which compares a pressure reading from the pressure gauge to a predetermined level and indication means which provide an indication when a measured pressure level is lower than the predetermined level, wherein the indication means includes a wireless transmission means to transmit the indication of low pressure to a computer, tablet or smart phone in response to the measured pressure level transitioning below the predetermined level.

2. A safety gate according to claim 1, wherein power storage means are provided to provide autonomous power to the processor and the indication means.

3. A safety gate according to claim 1, wherein the indication means is audible.

4. A safety gate according to claim 1, comprising two vertical upright post members each being attached at their lower ends to respective ends of the horizontal base member to form a U shaped frame, with attachment means provided at each end of each vertical upright post member.

5. A safety gate according to claim 4, wherein at least one of the vertical upright post members are attached to the horizontal base member at an angle greater than 90 degrees, such that when the frame is fitted in the opening and the attachment means are engaged, a pressure applied to the frame by the attachment means acting against the walls of the opening holds the frame securely in place in the opening and causes the at least one vertical upright post member to bend inwardly to be approximately 90 degrees to the horizontal base member.

6. A safety gate according to claim 1, wherein at least one of the vertical posts or horizontal base members are tubular.

7. A safety gate according to claim 6, wherein the electronic processing means are located inside one of the at least one tubular vertical posts or horizontal base member.

8. A safety gate according to claim 1, wherein the attachment means includes a threaded bolt which when turned, or when a nut is turned on the thread, causes the attachment means to move inwardly or outwardly which correspondingly applies less or more pressure between the frame and the walls of the opening.

9. A safety gate according to claim 1, wherein the attachment means includes a friction block which bears against a wall of the opening.

10. A safety gate according to claim 1, wherein the indication means provides an indication when the measured pressure level is higher than a maximum level.

* * * * *